US011303062B2

(12) United States Patent
Misu

(10) Patent No.: US 11,303,062 B2
(45) Date of Patent: Apr. 12, 2022

(54) CONNECTOR

(71) Applicant: SUMITOMO WIRING SYSTEMS, LTD., Mie (JP)

(72) Inventor: Takeshi Misu, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/053,437

(22) PCT Filed: May 14, 2019

(86) PCT No.: PCT/JP2019/019029
§ 371 (c)(1),
(2) Date: Nov. 6, 2020

(87) PCT Pub. No.: WO2019/221092
PCT Pub. Date: Nov. 21, 2019

(65) Prior Publication Data

US 2021/0249810 A1 Aug. 12, 2021

(30) Foreign Application Priority Data

May 17, 2018 (JP) ..... JP2018-095312

(51) Int. Cl.
*H01R 13/52* (2006.01)
*H01R 13/506* (2006.01)
*H01R 13/58* (2006.01)

(52) U.S. Cl.
CPC ..... *H01R 13/5205* (2013.01); *H01R 13/506* (2013.01); *H01R 13/5812* (2013.01)

(58) Field of Classification Search
CPC ..... H01R 13/65917; H01R 13/5812; H01R 13/5205; H01R 13/5206
See application file for complete search history.

(56) References Cited

U.S. PATENT DOCUMENTS 6,494,731 B1 12/2002 Suzuki
8,109,789 B2 2/2012 Tyler

FOREIGN PATENT DOCUMENTS

JP 2003-031295 A 1/2003
JP 2003-051354 A 2/2003

OTHER PUBLICATIONS

International Search Report dated Jul. 9, 2019 for WO 2019/221092 A1 (3 pages).

*Primary Examiner* — Briggitte R. Hammond
(74) *Attorney, Agent, or Firm* — Abelman, Frayne & Schwab

(57) ABSTRACT

A connector 10 includes a housing 12 provided with an opening 24, a cable 14 extending rearward from the opening 24, locking lances 44 resiliently displaceable toward the cable 14, and a retainer 16 to be mounted on the housing 12. The housing 12 includes cantilevered pressing portions 36 and the pressing portions 36 resiliently bring the locking lances 44 into contact with the cable 14 by pressing the locking lances 44 in directions toward the cable 14. The retainer 16 includes a base end wall 40 in which a first insertion hole 48 into which the cable 14 is inserted and second insertion holes 50 into which the pressing portions 33 are inserted are open, and water-wetting suppression walls 62 located behind the second insertion holes 50. The water-wetting suppression walls 62 have ranges overlapping insides of openings of the second insertion holes 50 when viewed from behind.

7 Claims, 9 Drawing Sheets

CONNECTOR

CROSS REFERENCE TO RELATED APPLICATIONS

This application is a national phase of PCT application No. PCT/JP2019/019029, filed on 14 May 2019, which claims priority from Japanese patent application No. 2018-095312, filed on 17 May 2018, all of which are incorporated herein by reference.

TECHNICAL FIELD

A technique disclosed by this specification relates to a connector.

BACKGROUND

A connector assembly described in Japanese Patent Laid-open Publication No. 2012-511804 is, for example, known as a conventional connector. This connector assembly includes an external sub-assembly extending in a front-rear direction, an internal sub-assembly arranged in the external sub-assembly and accommodating a terminal, a cable connected to the terminal and extending rearward, a cable seal to be mounted to cover a rear opening of the external sub-assembly and a retainer to be mounted on the external sub-assembly from behind.

PRIOR ART DOCUMENT

Patent Document

Patent Document 1: JP 2012-511804A

SUMMARY OF THE INVENTION

Problems to be Solved

However, there is a possibility that water intrudes into the connector from behind the connector and directly wets the cable seal. Particularly, if a water pressure is high such as during washing, there is a problem that the sealability of the cable seal cannot be sufficiently ensured.

Means to Solve the Problem

A connector disclosed in this specification includes a housing provided with an opening open rearward, a wire extending rearward from the opening, a locking lance disposed to face the wire, the locking lance being resiliently displaceable toward the wire, and a retainer to be mounted on the housing from side of the opening, the retainer holding the wire by the locking lance resiliently contacting the wire, wherein the housing includes a pressing portion cantilevered rearward from the opening and the pressing portion resiliently displaces the locking lance toward the wire to resiliently bring the locking lance into contact with the wire by pressing the locking lance in a direction toward the wire, the retainer includes a plate-like base end wall configured to come into contact with an opening edge of the opening from behind, a first insertion hole and a second insertion hole being open in the base end wall, the wire being inserted into the first insertion hole, the pressing portion being inserted into the second insertion hole, and a water-wetting suppression wall located behind the second insertion hole, the water-wetting suppression wall suppressing water intrusion into the opening through the second insertion hole, and the water-wetting suppression wall has a range overlapping inside of an opening of the second insertion hole when viewed from behind.

Since the water-wetting suppression wall has the range overlapping the inside of the opening of the second insertion hole when viewed from behind, direct intrusion of water into the opening through the second insertion hole is suppressed by the water contacting the water-wetting suppression wall when the retainer is wetted with water from behind the retainer.

Further, the locking lance may be provided to project rearward from the base end wall, and the water-wetting suppression wall may be provided to project from a rear end part of the locking lance in a direction opposite to a direction of the locking lance toward the wire and overlap a range from an opening edge on a side toward the wire to an opening edge on a side opposite to the side toward the wire in the opening of the second insertion hole when viewed from behind.

Since the water-wetting suppression wall overlaps the range from the opening edge of the second insertion hole on the side toward the wire to the opening edge of the second insertion hole on the side opposite to the side toward the wire when viewed from behind, it is possible to suppress water intrusion into the opening of the housing through a clearance between the water-wetting suppression wall and the opening edge of the second insertion hole on the side toward the wire and a clearance between the water-wetting suppression wall and the opening edge of the second insertion hole on the side opposite to the side toward the wire.

Further, the locking lance may include a curved portion having a curved shape in conformity with an outer peripheral surface of the wire and the curved portion may be provided with a slit extending in an extending direction of the wire, the water-wetting suppression wall may be composed of a pair of individual water-wetting suppression walls, the pair of individual water-wetting suppression walls may be provided to project from a rear end part of the curved portion in a direction opposite to a direction of the curved portion toward the wire, and one of the pair of individual water-wetting suppression walls may be provided on one side of the slit in a curving direction and the other individual water-wetting suppression wall may be provided on a side of the slit opposite to the one side in the curving direction.

The curved portion is divided by providing the slit in the curved portion, whereby the curved portion can be easily deflected. By providing the individual water-wetting suppression wall on each of parts of the curved portion divided by the slit, the range overlapping the inside of the opening of the second insertion hole can be made wider when viewed from behind as compared to a configuration in which the individual water-wetting suppression wall is provided on either one of the divided parts.

An individual water-wetting suppression wall coupling portion coupling mutually facing side surfaces of the pair of individual water-wetting suppression walls may be provided between the pair of individual water-wetting suppression walls.

By providing the individual water-wetting suppression wall coupling portion, water intrusion into the second insertion hole through a clearance between the pair of individual water-wetting suppression walls can be suppressed.

Effect of the Invention

According to the connector disclosed in this specification, it is possible to provide a connector which suppresses direct water-wetting of a seal ring.

DETAILED DESCRIPTION TO EXECUTE THE INVENTION

Embodiment

An embodiment is described with reference to FIGS. 1 to 9. In the following description, an X direction, a Y direction and a Z direction in FIGS. 1 to 9 are referred to as a forward direction, a rightward direction and an upward direction.

Figure 1:
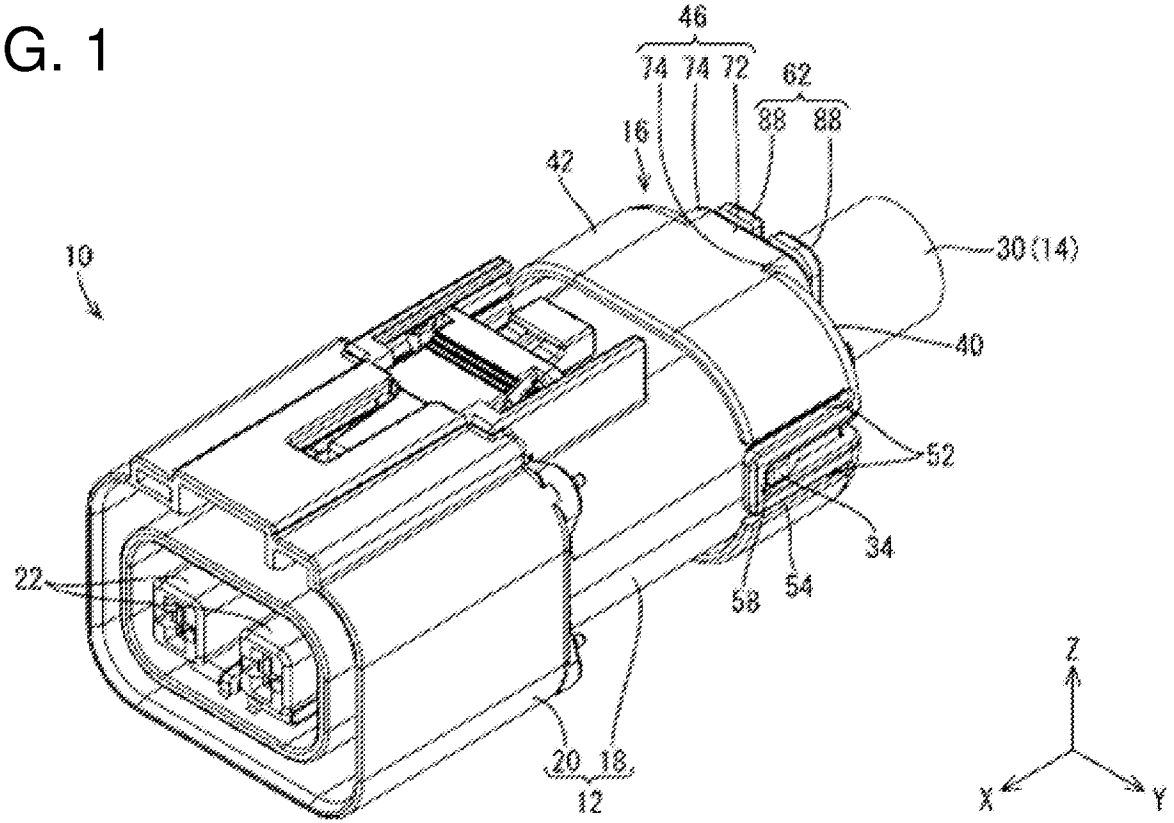
FIG. 1 is a front perspective view of a connector in an embodiment.

The connector 10 of this embodiment includes a housing 12 to be connected to a mating connector (not shown) and a retainer 16 to be mounted on the housing 12 from behind as shown in FIG. 1.

As shown in FIG. 1, the housing 12 is composed of a terminal accommodating portion 18 having a tubular shape long in a front-rear direction and a housing-side receptacle 20 provided on the outer periphery of a front part of the terminal accommodating portion 18 and open forward. A pair of left and right cavities 22 in the form of rectangular tubes are provided in the terminal accommodating portion 18, and terminals are respectively accommodated in the pair of left and right cavities 22.

Figure 2:
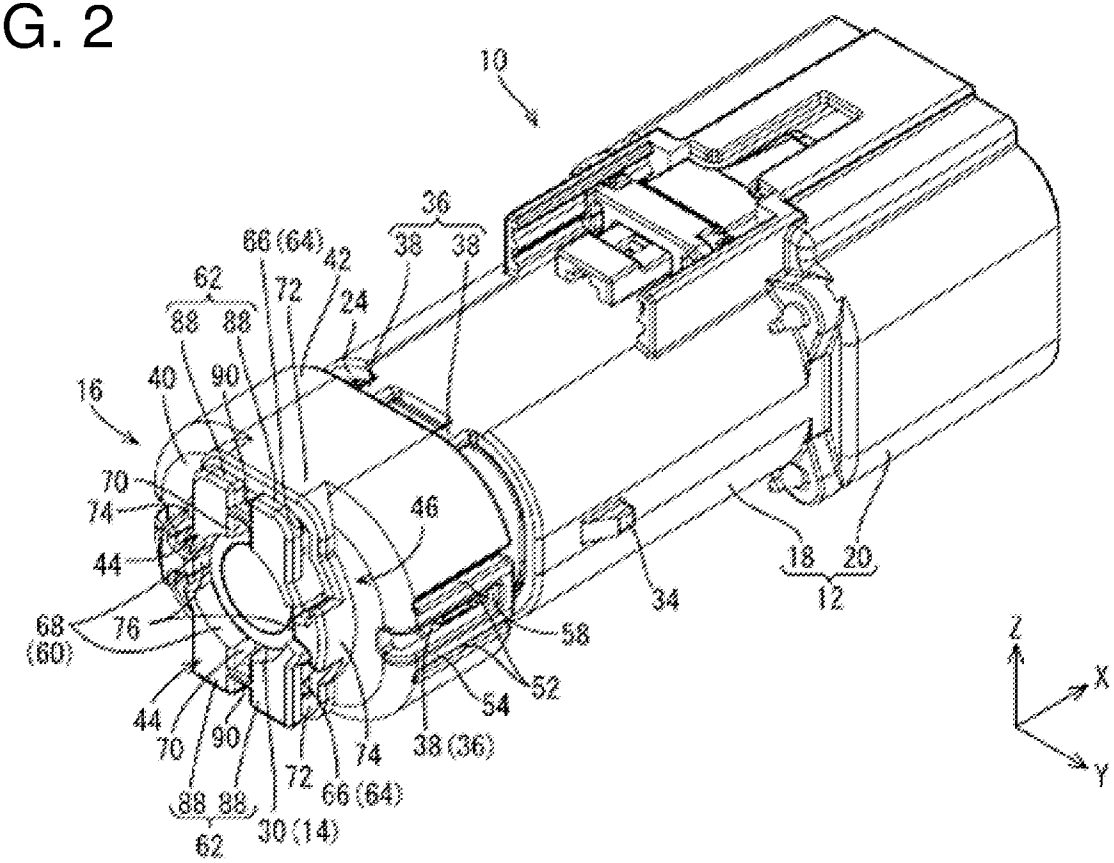
FIG. 2 is a rear perspective view of the connector before a retainer is mounted.

As shown in FIG. 2, the terminal accommodating portion 18 is provided with an opening 24 open rearward, and a multi-core cable 14 in which two coated wires (not shown) are bundled and covered with an outer sheath is inserted into the opening 24. Cores (not shown) of the two coated wires of the cable 14 are respectively electrically connected to the terminals in the pair of cavities 22.

Figure 6:
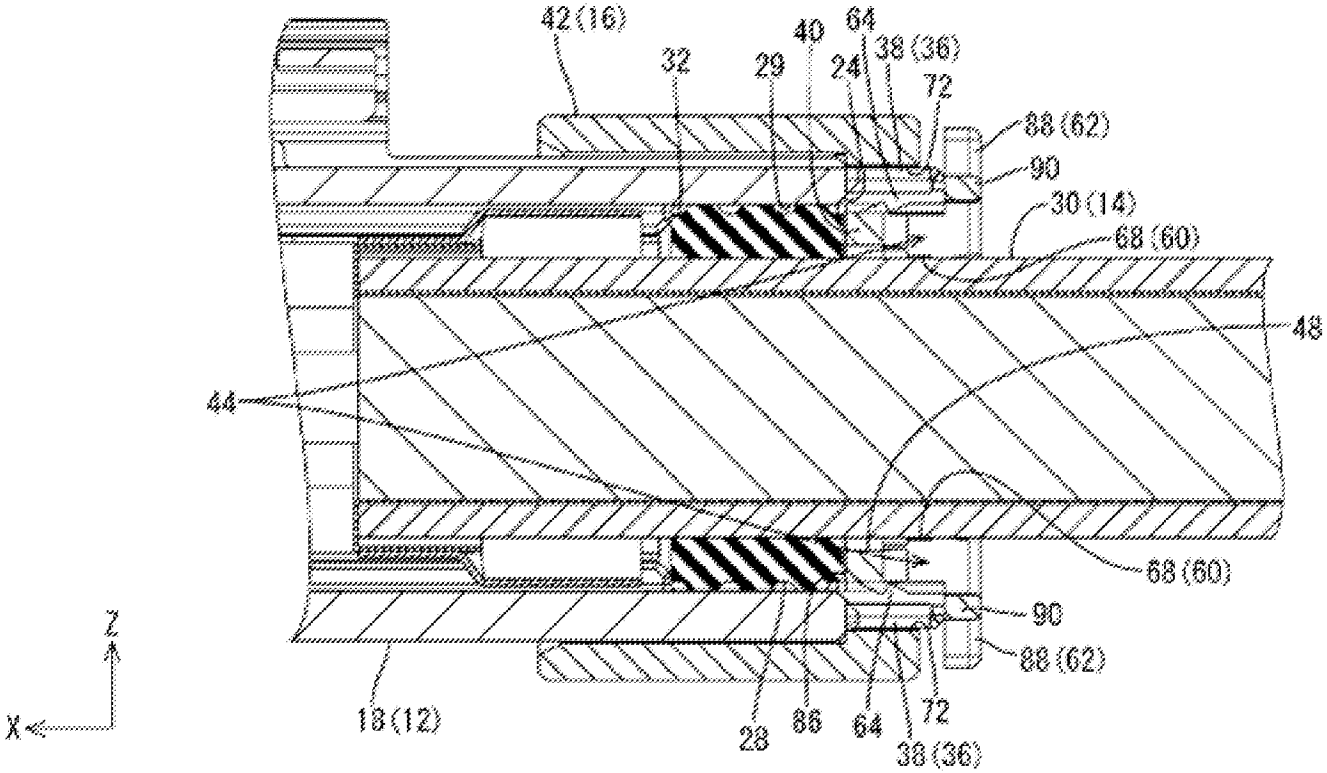
FIG. 6 is a section along A-A in FIG. 5.

As shown in FIG. 6, an annular ring 28 is inserted on the cable 14 and accommodated in the opening 24. The outer peripheral surface of the seal ring 28 is resiliently in contact with an inner peripheral surface 29 of the opening 24 of the terminal accommodating portion 18, and the inner peripheral surface of the seal ring 28 is resiliently in contact with an outer peripheral surface 30 of the cable 14. In this way, water intrusion into the terminal accommodating portion 18 through the opening 24 of the terminal accommodating portion 18 is suppressed. A front contact wall 32 configured to come into contact with the front surface of the seal ring 28 is provided in the terminal accommodating portion 18, whereby the seal ring 28 is prevented from being displaced forward in the terminal accommodating portion 18.

Figure 3:
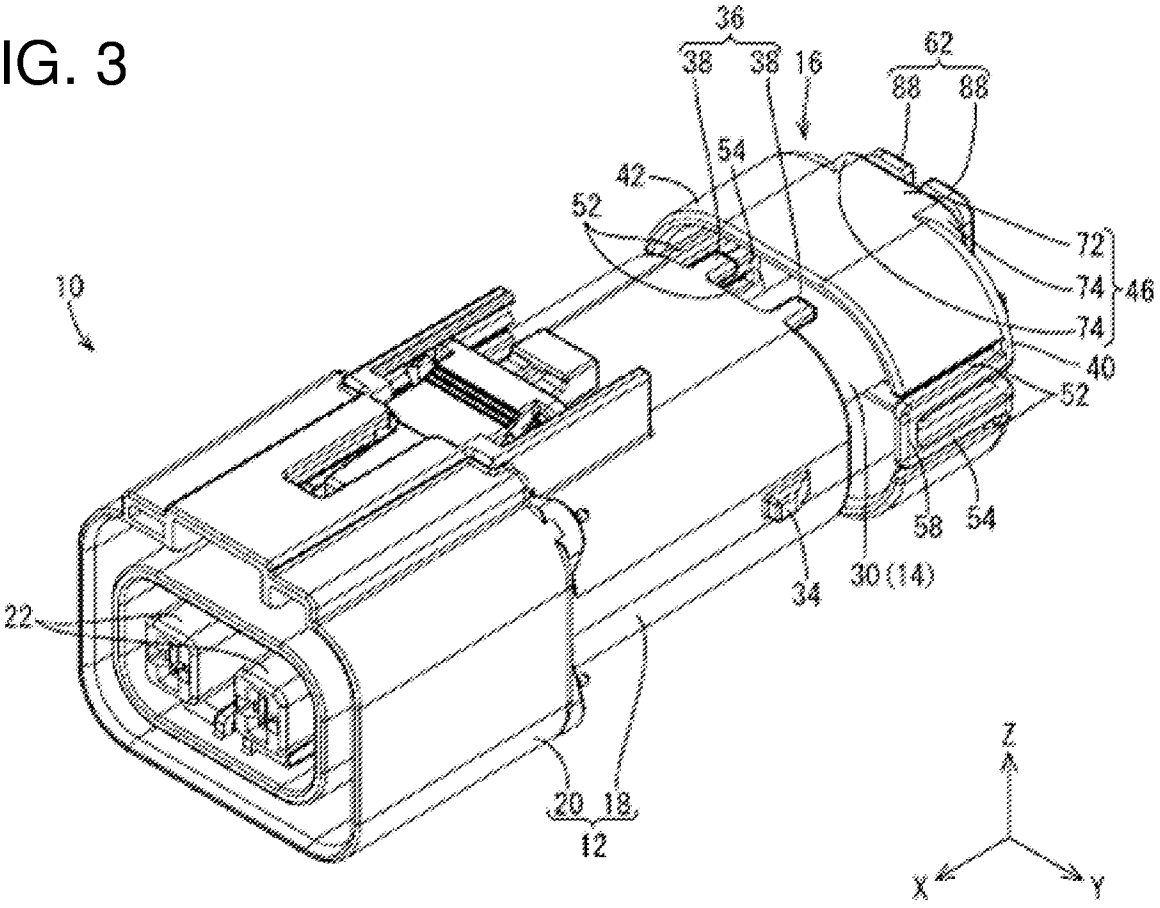
FIG. 3 is a front perspective view of the connector before the retainer is mounted.
Figure 4:
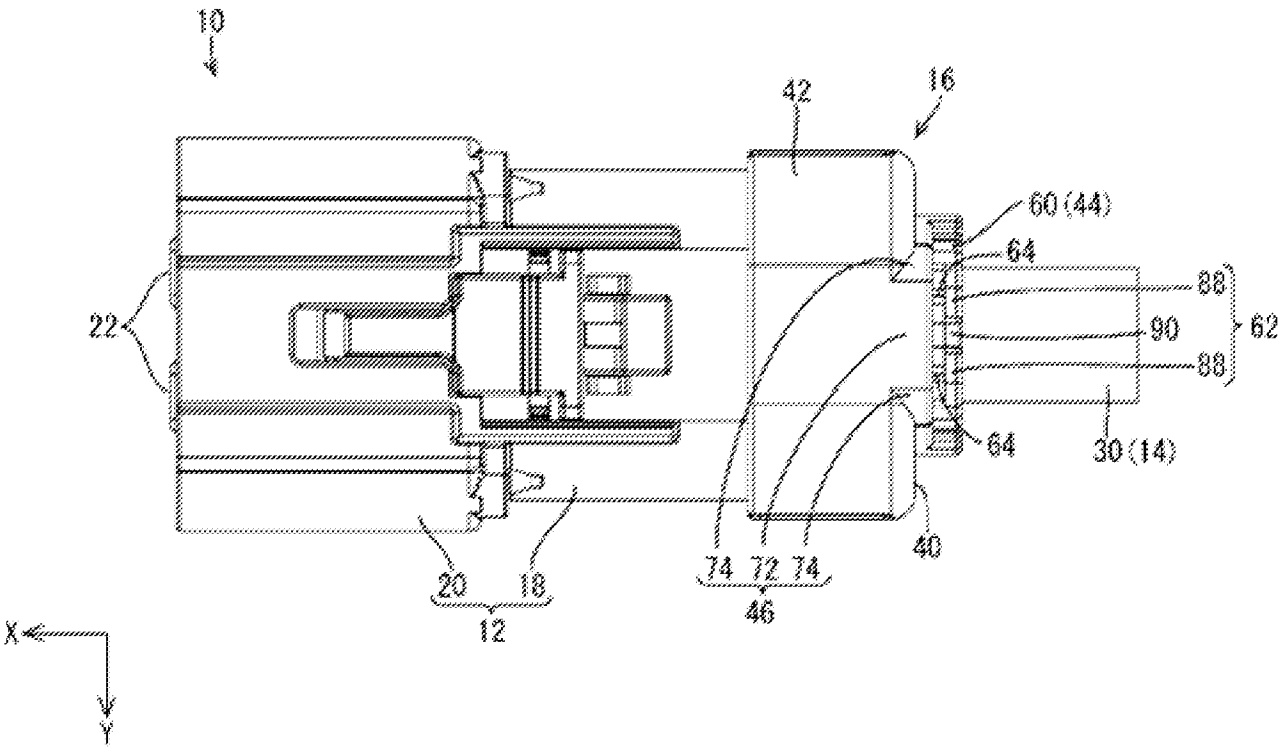
FIG. 4 is a plan view of the connector.

As shown in FIGS. 2 and 3, a pair of housing-side lock portions 34 for preventing the retainer 16 to be described later from coming out rearward are respectively provided to project outward on both side surfaces of the terminal accommodating portion 18. Further, the terminal accommodating portion 18 is provided with a pair of upper and lower pressing portions 36 respectively projecting rearward from an upper end opening edge and a lower end opening edge of the opening 24.

Out of the pair of upper and lower pressing portions 36, the upper pressing portion 36 is composed of a pair of left and right individual pressing portions 38 cantilevered rearward from the upper end opening edge of the opening 24 and the pair of left and right individual pressing portions 38 are at a predetermined interval in a lateral direction as shown in FIG. 2. Similarly to the upper pressing portion 36, the lower pressing portion 36 is composed of a pair of left and right individual pressing portions 38 cantilevered rearward from the lower end opening edge of the opening 24.

Figure 8:
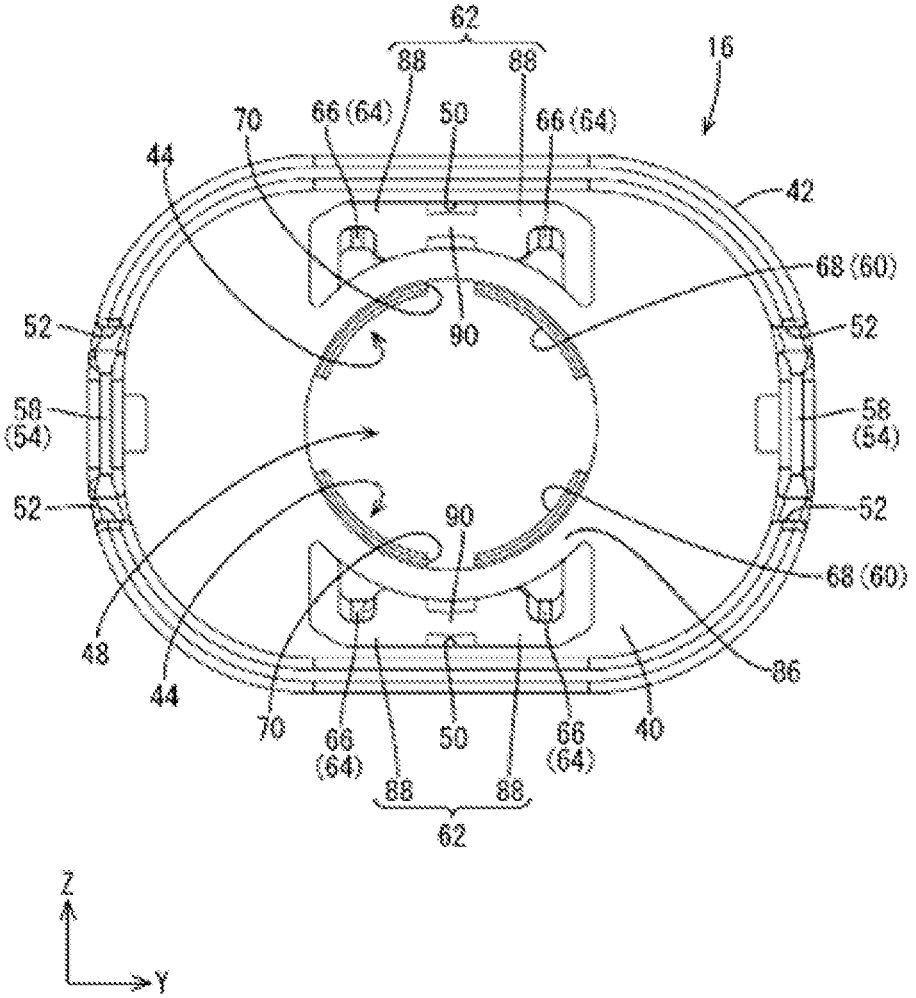
FIG. 8 is a front view of the retainer.
Figure 9:
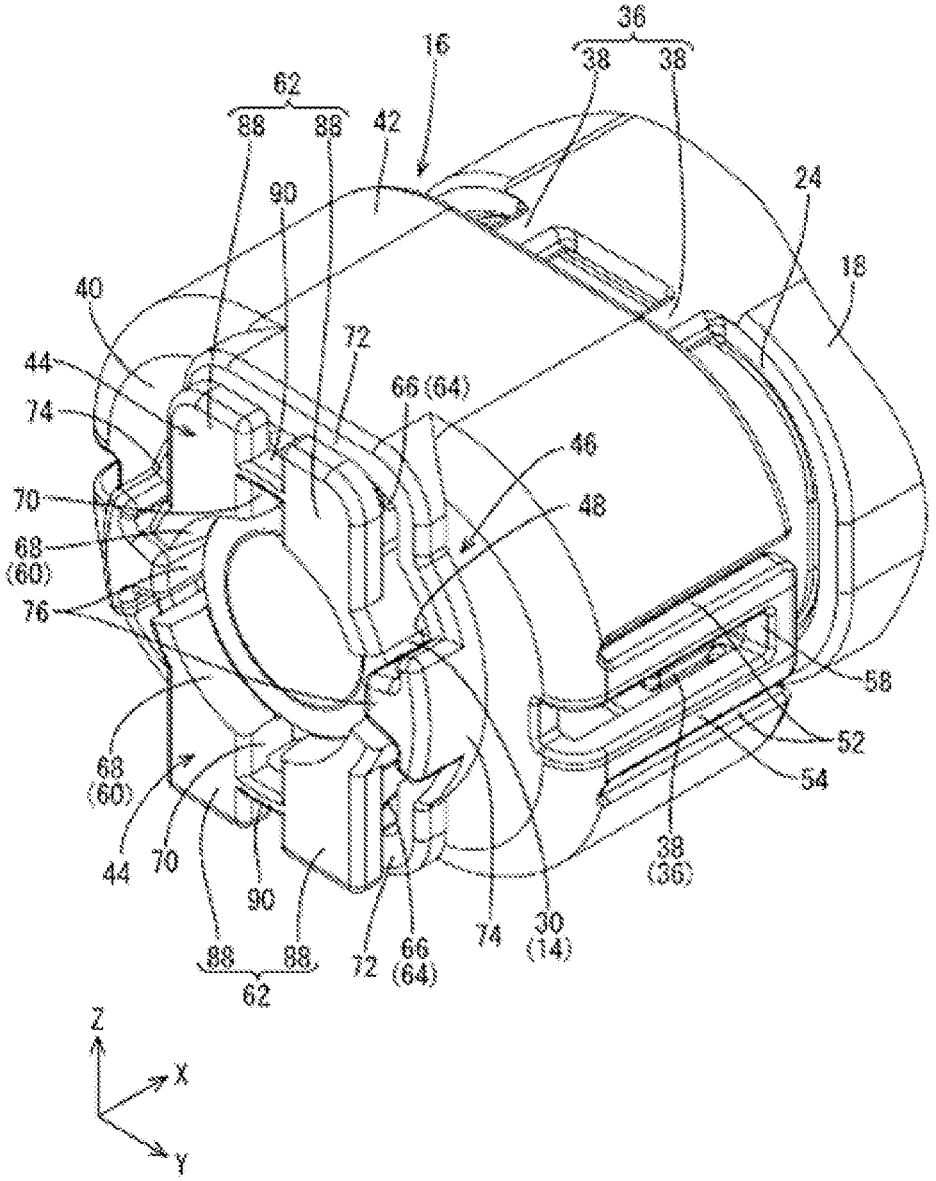
FIG. 9 is an enlarged view near the retainer in FIG. 2.

The retainer 16 is a retainer for holding the cable 14 and the seal ring 28 in the housing 12 and includes, as shown in FIG. 9, a base end wall 40 in the form of an elliptical plate long in the lateral direction, a retainer-side receptacle 42 open forward from the outer peripheral edge of the base end wall 40 and a frame portion 46 having a frame shape and projecting rearward from the rear surface of the base end wall 40. The retainer 16 is integrally molded to a pair of upper and lower locking lances 44 projecting rearward from the rear surface of the base end wall 40. As shown in FIG. 1, the retainer 16 is so mounted on the housing 12 that the retainer-side receptacle 42 covers the opening 24 of the terminal accommodating portion 18. As shown in FIG. 8, a first insertion hole 48 into which the cable 14 is inserted is provided to be open in a center of the base end wall 40, and a pair of upper and lower second insertion holes 50 into which the pair of upper and lower pressing portions 36 are respectively inserted and which are respectively located above and below the first insertion hole 48 are provided to be open in the base end wall 40. The pair of upper and lower second insertion holes 50 are holes formed by a mold for molding the retainer 16 and the pair of upper and lower locking lances 44.

As shown in FIG. 3, two first slits 52 cut in the front-rear direction are provided at a predetermined interval in a vertical direction in each of both side surfaces of the retainer-side receptacle 42, whereby a pair of left and right lock arms 54 resiliently displaceable in the lateral direction are formed. The pair of lock arms 54 have openings long in the front-rear direction in vertical centers, and front end parts of the opening edges of those openings serve as retainer-side lock portions 58.

If the retainer 16 is mounted on the housing 12, the retainer-side lock portions 58 can come into contact with the housing-side lock portions 34 from front and the retainer 16 is prevented from being detached rearward from the housing 12.

As shown in FIG. 9, the pair of upper and lower locking lances 44 are cantilevered rearward (in an extending direction of the cable 14) from the opening edge of the first insertion hole 48 of the base end wall 40.

The retainer 16 holds the cable 14 via the pair of upper and lower locking lances 44. Out of the pair of upper and lower locking lances 44, the upper locking lance 44 is first described. As shown in FIGS. 8 and 9, the upper locking lance 44 includes a curved portion 60, a water-wetting suppression wall 62 and a pair of left and right projections 64.

As shown in FIG. 9, the curved portion 60 is provided to extend rearward (in the extending direction of the cable 14) from the opening edge of the first insertion hole 48 and has a curved shape in conformity with the outer peripheral surface 30 of the cable 14. As shown in FIGS. 8 and 9, the pair of left and right projections 64 are provided in front of the water-wetting suppression wall 62 and respectively provided to project upward from both end sides in the lateral direction (curving direction) of the curved portion 60. As shown in FIG. 9, tapered surfaces 66 inclined forward toward the upper surface of the curved portion 60 are provided on upper end parts of the pair of projections 64. Further, the lower surface of the curved portion 60 serves as a sawtooth-like portion 68 having a sawtooth shape. When the cable 14 is held in the housing 12, the sawtooth-like portion 68 bites into the cable 14. Thus, a holding force of the cable 14 is improved. Further, since the curved portion 60 extends in the extending direction of the cable 14, a contact area of the sawtooth-like portion 68 and the cable 14 is large and the holding force of the cable 14 is improved.

Figure 7:
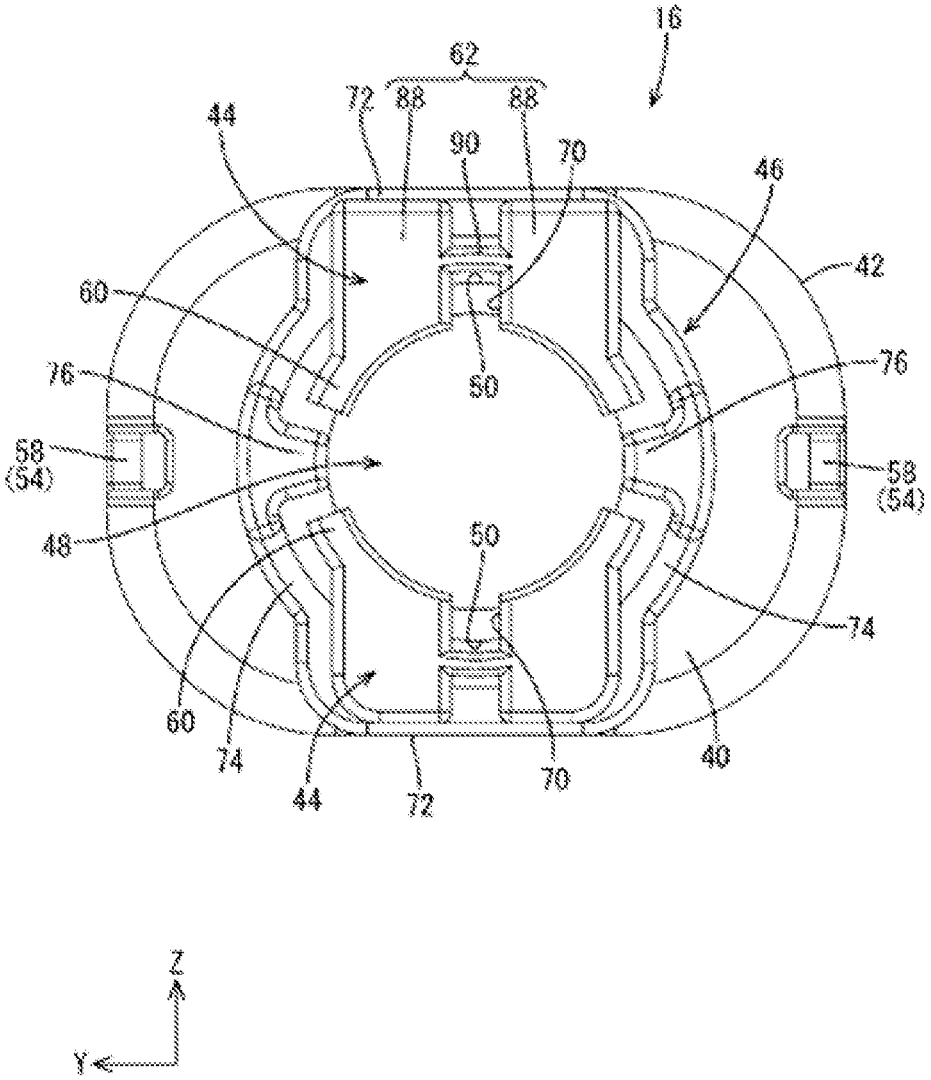
FIG. 7 is a back view of the retainer.

As shown in FIGS. 7 and 9, a second slit 70 cut in the front-rear direction (extending direction of the cable 14) is provided in a center between a pair of left and right individual water-wetting suppression walls 88 (and the pair of left and right projections 64) provided on a rear end part of the curved portion 60, whereby the curved portion 60 is divided into left and right parts.

The water-wetting suppression wall 62 is composed of the pair of left and right individual water-wetting suppression walls 88 as shown in FIG. 9, and the pair of left and right individual water-wetting suppression walls 88 are respectively provided to project upward from the rear end part of the curved portion 60. Out of the pair of left and right individual water-wetting suppression walls 88, the left individual water-wetting suppression wall 88 is located to the left of the second slit 70, and the right individual water-wetting suppression wall 88 is located to the right of the second slit 70. An individual water-wetting suppression coupling portion 90 is provided between the pair of left and right individual water-wetting suppression walls 88, and the individual water-wetting suppression wall coupling portion 90 is connected to each of mutually facing side surfaces of the pair of left and right individual water-wetting suppression walls 88.

The pair of left and right individual water-wetting suppression walls 88 are provided in ranges overlapping the inside of the second insertion hole 50 when viewed from behind as shown in FIG. 7 and overlap a range of the second insertion hole 50 from an upper end opening edge to a lower end opening edge as shown in FIG. 8. Further, the individual water-wetting suppression wall coupling portion 90 overlaps the inside of the opening of the second insertion hole 50 when viewed from behind.

Since the projections 64 are accommodated in the opening of the second insertion hole 50 as shown in FIG. 8, water may intrude into the opening 24 through clearances between the projections 64 and the opening edge of the second insertion hole 50 and the seal ring 28 may be directly wetted with water if the water-wetting suppression wall 62 is not provided. However, since the pair of individual water-wetting suppression walls 88 and the individual water-wetting suppression wall coupling portion 90 are provided at positions overlapping the inside of the second insertion hole 50 when viewed from behind, water trying to intrude into the second insertion hole 50 contacts the pair of individual water-wetting suppression walls 88 and the individual water-wetting suppression wall coupling portion 90. Thus, the intrusion of the water into the opening 24 through the second insertion hole 50 is suppressed, whereby direct water-wetting of the seal ring 28 in the opening 24 is suppressed.

Out of the pair of upper and lower locking lances 44, the lower locking lance 44 has a vertically symmetrical shape with the upper locking lance 44 and has the same configuration as the upper locking lance 44 in other points as shown in FIG. 7.

Figure 5:
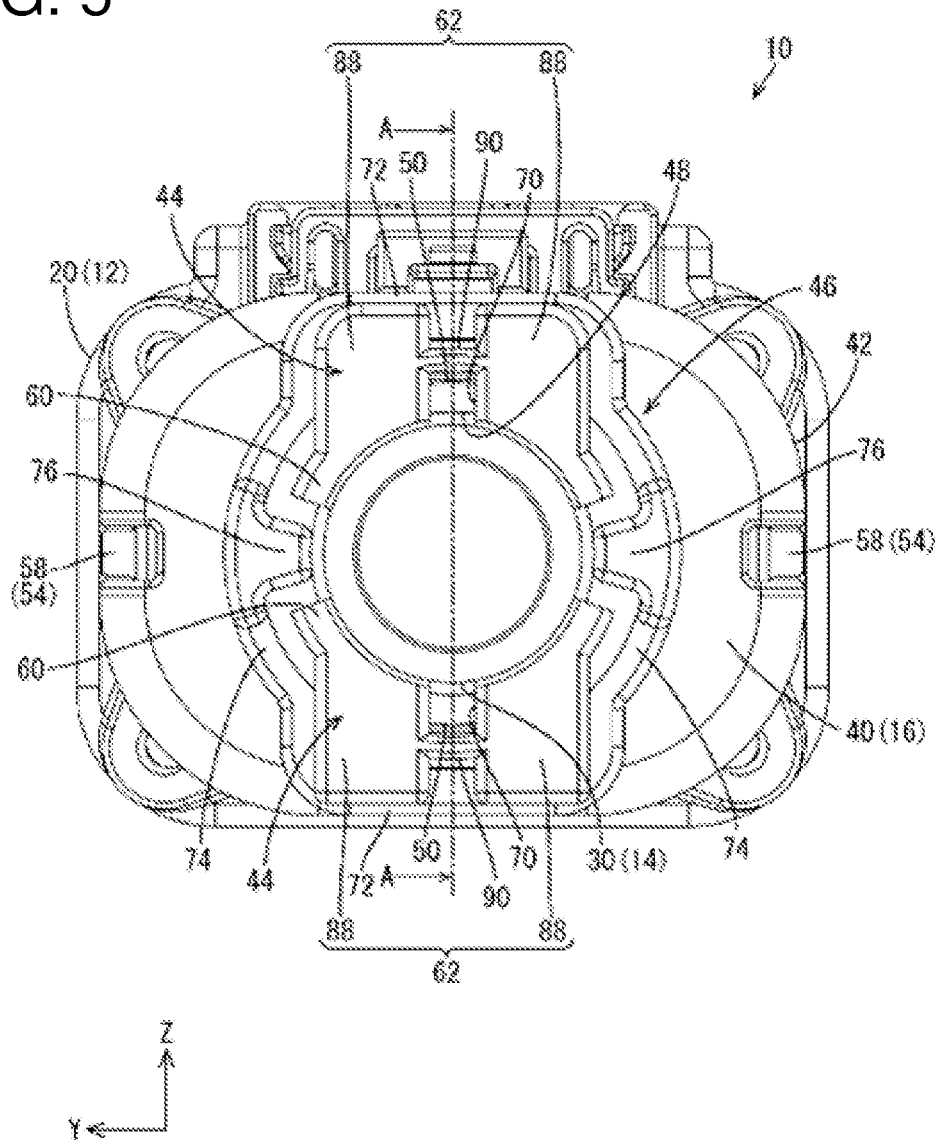
FIG. 5 is a back view of the connector.

As shown in FIG. 9, the frame portion 46 is composed of a pair of upper and lower displacement preventing portions 72 respectively projecting rearward from upper and lower end parts of the base end wall 40 and a pair of left and right coupling portions 74 respectively coupling both left and right end parts of the pair of upper and lower displacement preventing portions 72. The pair of upper and lower coupling portions 74 are provided with a pair of left and right projecting portions 76 projecting laterally inwardly of the frame portion 46 from surfaces facing each other. The pair of left and right projecting portions 76 are respectively in contact with the cable 14 in the lateral direction as shown in FIG. 5, thereby restricting a lateral displacement of the cable 14.

If the retainer 16 is mounted on the housing 12, the pair of upper and lower pressing portions 36 of the housing 12 are inserted between the pair of upper and lower displacement preventing portions 72 of the retainer 16 and the projections 64 of the pair of upper and lower locking lances 44 as shown in FIG. 6. The pairs of left and right individual pressing portions 38 of the pressing portions 36 respectively individually press the pairs of left and right projections 64 in directions of the locking lances 44 toward the cable 14. In this way, the locking lances 44 are resiliently displaced toward the cable 14, and the sawtooth-like portions 68 of the curved portions 60 of the locking lances 44 resiliently contact the cable 14. Further, the locking lances 44 are resiliently displaced in directions opposite to the directions toward the cable 14 by a reaction force of the cable 14 generated due to the resilient contact of the locking lances 44 with the cable 14. In this way, the pairs of left and right individual pressing portions 38 are resiliently displaced in the directions opposite to the directions toward the cable 14 and resiliently contact the displacement preventing portions 72 from the directions opposite to the directions toward the cable 14.

If the retainer 16 is mounted on the housing 12, the opening edge of the first insertion hole 48 of the base end wall 40 comes into contact with the seal ring 28 from behind as shown in FIG. 6 to prevent the seal ring 28 from coming out rearward, and a part of the opening edge of the first insertion hole 48 that comes into contact with the seal ring 28 from behind serve as a contact portion 86.

Next, functions of this embodiment are described.

It is assumed that the retainer 16 is wetted with water drops from behind the retainer 16. At this time, the water drops flying toward the second insertion hole 50 contact the pair of individual water-wetting suppression walls 88 provided in front of the second insertion hole 50 and the intrusion of the water drops into the opening 24 through the second insertion hole 50 is suppressed. Further, even if the water drops are going to intrude through the clearance between the pair of individual water-wetting suppression walls 88, the intrusion of the water drops into the opening 24 through the second insertion hole 50 is suppressed since the water drops contact the individual water-wetting suppression wall coupling portion 90 provided between the pair of individual water-wetting suppression walls 88.

As described above, according to this embodiment, the water-wetting suppression wall 62 has a range overlapping the inside of the second insertion hole 50 when viewed from behind. Thus, when the retainer 16 is wetted with water from behind the retainer 16, direct intrusion of the water into the opening 24 through the second insertion hole 50 is suppressed by the water contacting the water-wetting suppression wall 62.

Further, since the water-wetting suppression wall 62 covers the second insertion hole 50 between the opening edge on a side toward the cable (wire) 14 and the opening edge on a side opposite to the side toward the cable (wire) 14 when viewed from behind, it is possible to suppress water intrusion into the opening 24 of the housing 12 through a clearance between the water-wetting suppression wall 62 and the opening edge of the second insertion hole 50 on the side toward the cable (wire) 14 and a clearance between the water-wetting suppression wall 62 and the opening edge on the side of the second insertion hole 50 opposite to the side toward the cable (wire) 14.

Further, the curved portion 60 is divided by providing the second slit (slit) 70 in the curved portion 60, whereby the curved portion 60 can be easily deflected. By providing the individual water-wetting suppression wall 88 on each of the parts of the curved portion 60 divided by the second slit (slit) 70, the range overlapping the inside of the second insertion hole 50 can be made wider when viewed from behind as compared to a configuration in which the individual water-wetting suppression wall 88 is provided only on either one of the divided parts.

Further, water intrusion into the second insertion hole 50 through the clearance between the pair of individual water-wetting suppression walls 88 can be suppressed by providing the individual water-wetting suppression wall coupling portion 90.

Other Embodiments

The technique disclosed by this specification is not limited to the above described and illustrated embodiment. For example, the following various modes are also included.

(1) Although the pair of upper and lower locking lances 44 of the retainer 16 respectively resiliently contact the cable 14 from upper and lower sides to hold the cable 14 in the housing 12 in the above embodiment, a pair of left and right locking lances may be provided and resiliently contact a cable from left and right sides. Further, one locking lance may be provided and resiliently contact a cable from one side to hold the cable.

(2) Although the pressing portion 36 of the housing 12 is composed of the pair of left and right individual pressing portions 38 and the pair of left and right individual pressing portions 38 respectively press the pair of left and right projections 64 of the retainer 16 in the above embodiment, one pressing portion may simultaneously press the pair of left and right projections 64.

(3) Although the locking lance 44 is provided with the projections 64 and the pressing portion 36 of the housing 12 presses the projections 64 in the above embodiment, a projection may be provided on a pressing portion without providing any projection on a locking lance and the projection of the pressing portion may press a curved portion of the locking lance.

(4) Although the displacement preventing portions 72 are made hard to deflect by coupling the both ends of the pair of upper and lower displacement preventing portions 72 respectively by the pair of left and right coupling portions 74 in the above embodiment, the pair of left and right coupling portions 74 may not, for example, be provided and displacement preventing portions may be made hard to deflect by being thickened.

(5) Further, a retainer and locking lances may be integrally molded. The integrally molded retainer and locking lances are preferable in terms of reducing cost as compared to the case where the retainer and the locking lances are individually molded. Further, in the case of integrally molding the retainer and the locking lances, mold removal holes may be necessary. In this case, if the second insertion holes are mold removal holes, it is preferable since water intrusion can also be suppressed by the water-wetting suppression wall while integral molding is facilitated.

LIST OF REFERENCE NUMERALS

10: connector
12: housing
14: cable (wire)
16: retainer
24: opening
36: pressing portion
40: base end wall
44: locking lance
48: first insertion hole
50: second insertion hole
62: water-wetting suppression wall
70: second slit (slit)
88: individual water-wetting suppression wall
90: individual water-wetting suppression wall coupling portion

What is claimed is:

1. A connector, comprising:

a housing provided with an opening open rearward;

a wire extending rearward from the opening;

a locking lance disposed to face the wire, the locking lance being resiliently displaceable toward the wire; and a retainer to be mounted on the housing from side of the opening, the retainer holding the wire by the locking lance resiliently contacting the wire, wherein:

the housing includes a pressing portion cantilevered rearward from the opening and the pressing portion resiliently displaces the locking lance toward the wire to resiliently bring the locking lance into contact with the wire by pressing the locking lance in a direction toward the wire, the retainer includes a plate-like base end wall configured to come into contact with an opening edge of the opening from behind, a first insertion hole and a second insertion hole being open in the base end wall, the wire being inserted into the first insertion hole, the pressing portion being inserted into the second insertion hole, and a water-wetting suppression wall located behind the second insertion hole, the water-wetting suppression wall suppressing water intrusion into the opening through the second insertion hole, and the water-wetting suppression wall has a range overlapping inside of an opening of the second insertion hole when viewed from behind.

2. The connector of claim 1, wherein:

the locking lance is provided to project rearward from the base end wall, and the water-wetting suppression wall is provided to project from a rear end part of the locking lance in a direction opposite to a direction of the locking lance toward the wire and overlaps a range from an opening edge on a side toward the wire to an opening edge on a side opposite to the side toward the wire in the opening of the second insertion hole when viewed from behind.

3. The connector of claim 2, wherein:

the locking lance includes a curved portion having a curved shape in conformity with an outer peripheral surface of the wire and the curved portion is provided with a slit extending in an extending direction of the wire, the water-wetting suppression wall is composed of a pair of individual water-wetting suppression walls divided by the slit, and the pair of individual water-wetting suppression walls are respectively provided to project from a rear end part of the curved portion in a direction opposite to a direction of the curved portion toward the wire.

4. The connector of claim 3, wherein an individual water-wetting suppression wall coupling portion coupling mutually facing side surfaces of the pair of individual water-wetting suppression walls is provided between the pair of individual water-wetting suppression walls.

5. A connector, comprising:

a housing including an opening into which a wire is inserted, and a retainer to be mounted on a side of the housing into which side the wire is inserted, the retainer holding the wire, wherein:

the retainer includes:

a first insertion hole into which the wire is inserted, a second insertion hole, and a locking lance to hold the wire, the housing includes a pressing portion for applying a pressing force for holding the wire inserted into the first insertion hole to the retainer as the pressing portion is inserted into the second insertion hole, and the retainer includes a water-wetting suppression wall overlapping at least a part of the second insertion hole in a direction of the second insertion hole opposite to the housing.

6. The connector of claim 5, wherein the retainer and the locking lance are integrally molded.

7. The connector of claim 6, wherein the second insertion hole is a hole formed by a mold for molding the retainer and the locking lance.

* * * * *